United States Patent [19]

Stroucken

[11] 4,354,632

[45] Oct. 19, 1982

[54] OPERATING SYSTEM FOR CENTRIFUGES

[75] Inventor: Klaus H. D. Stroucken, Ronninge, Sweden

[73] Assignee: Alfa-Laval AB, Tumba, Sweden

[21] Appl. No.: 157,525

[22] Filed: Jun. 9, 1980

[30] Foreign Application Priority Data

Jun. 20, 1979 [SE] Sweden ..... 7905419

[51] Int. Cl.[3] ..... B04B 11/00

[52] U.S. Cl. ..... 233/20 A; 233/39

[58] Field of Search ..... 233/20 R, 20 A, 46, 233/47 R, 47 A, 19 R, 19 A, 39

[56] References Cited

U.S. PATENT DOCUMENTS

| | | | |
|---|---|---|---|
| 2,840,302 | 6/1958 | Steinacker | 233/20 A |
| 4,044,945 | 8/1977 | Kohlstette | 233/20 A |
| 4,143,806 | 3/1979 | Moriguchi | 233/20 A |
| 4,164,317 | 8/1979 | Nelson | 233/20 A |

FOREIGN PATENT DOCUMENTS 662451 12/1951 United Kingdom .

*Primary Examiner*—Robert W. Jenkins

*Attorney, Agent, or Firm*—Cyrus S. Hapgood

[57] ABSTRACT

In a centrifugal rotor having an axially movable slide for opening and closing peripheral outlets from the separating chamber, there is formed a so-called closing chamber between the slide and the rotor body. The closing chamber is charged with operating liquid from the central axis of the rotor through a channel in the rotor. In the passage between the channel and the closing chamber are means by which the hydraulic pressure exerted on the slide from operating liquid in the channel is first reduced or eliminated in connection with discharge of operating liquid from the closing chamber and thereafter is again caused to act for closing of the slide.

11 Claims, 2 Drawing Figures

OPERATING SYSTEM FOR CENTRIFUGES

Figure 1:
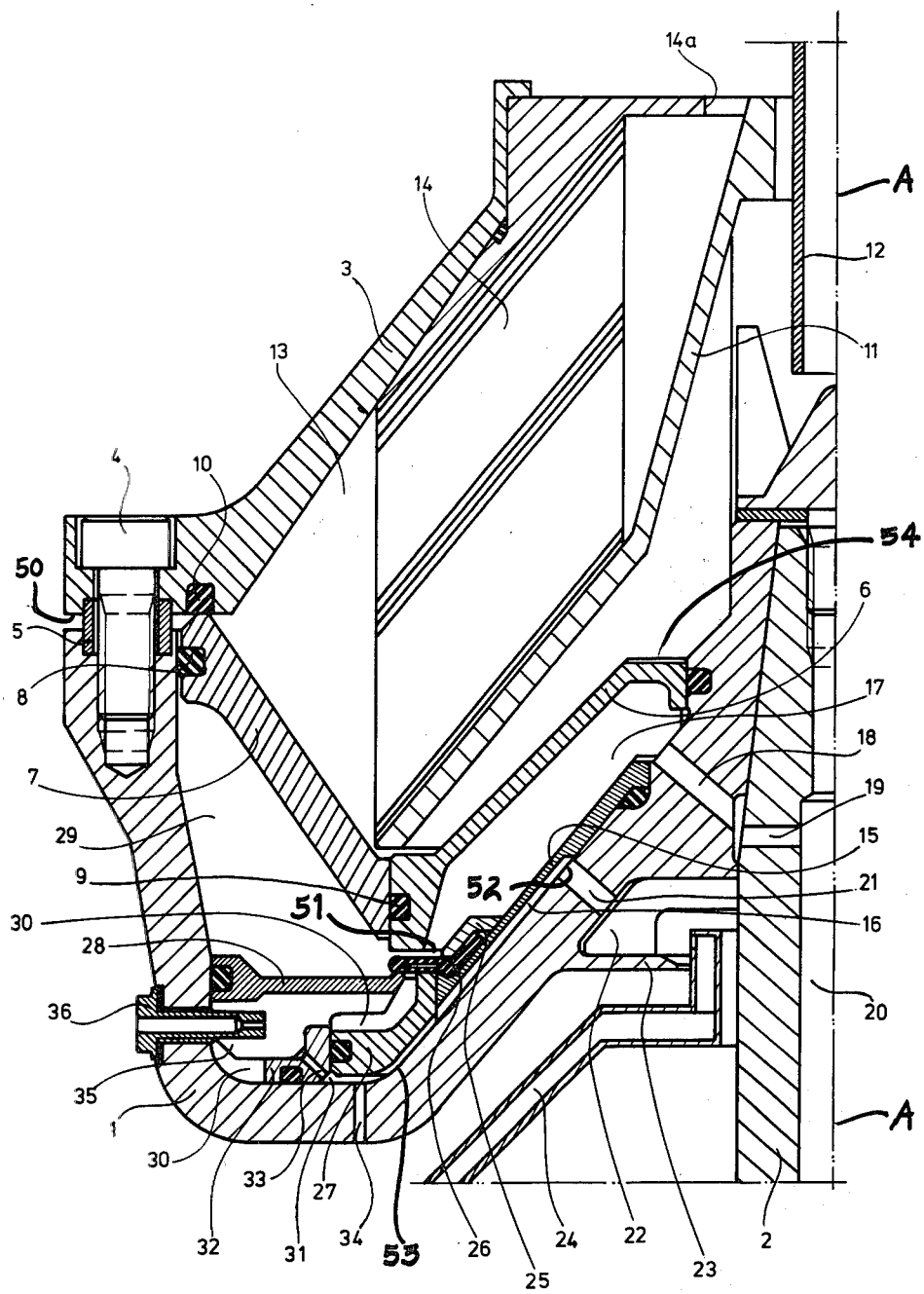

The present invention relates to a centrifugal separator of the kind in which the rotor forms a separating chamber with a central inlet for a liquid mixture of at least two components, a central outlet for one separated component, and peripheral outlets distributed around the periphery of the rotor for another separated component. An annular slide member is axially movable during operation for opening and closing the peripheral outlets and forms with the rotor body a so-called closing chamber communicating with at least one channel in the rotor which is arranged to be charged with operating liquid. This channel and the closing chamber are kept filled during operation with operating liquid hydraulically actuating the slide member to a closing position, the rotor also having a valve for discharging operating liquid from the closing chamber so that the slide member is forced to a position for opening the peripheral outlets of the separating chamber.

Centrifugal separators of this kind have long been known and are used in several fields for separation of sludge from sludge-containing liquids. A desideratum in connection with such centrifugal separators is that said annular slide member should move during the sludge discharge operations as fast as possible, during the opening phase as well as the closing phase, so that the largest possible outflow area of sludge can be achieved. The larger the outflow area, the more effectively separated sludge having a tendency to adhere (or having already adhered) on the walls of the separating chamber may be caused to be entrained in the movement of sludge and liquid, which occurs when the sludge outlets are opened.

A disadvantage with previously known centrifugal separators of this kind is that if the channel which communicates with the closing chamber for supply of operating liquid in dimensioned to enable a rapid opening movement of the annular slide member, the result is a correspondingly slow closing movement of the slide member, and vice versa. Therefore, if the channel is made narrow so that it can be rapidly drained, and the liquid level thus can be rapidly moved radially outwards when the operating liquid outlet from the closing chamber is opened, the slide member will have a rapid opening movement; but the resulting drawback is that the amount of operating liquid discharged from the closing chamber cannot be replaced as rapidly as desired when the annular slide member is to be returned to its position for closing of the sludge outlets. Thus, in this case a rapid opening movement of the slide member is achieved but at the expense of a correspondingly slow closing movement. If said channel is instead given a relatively large through-flow area, a slower opening movement of the slide member is obtained, whereas the closing movement may be made more rapid; but the closing cannot be more rapid than is allowed by the rate at which the channel can be charged with new operating liquid through the central parts of the rotor.

The principal object of the present invention is to provide an improved centrifugal separator of the above-noted kind which attains a large outflow area of the peripheral sludge outlets during a sludge discharge operation.

A centrifugal separator made according to the invention is characterized by means which, when operating liquid is discharged from the closing chamber by actuation of said valve, act to retain operating liquid in the channel and thereby maintain the operating liquid pressure therein substantially unchanged, and to reduce the hydraulic pressure on the slide member caused by operating liquid thus retained in the channel. Preferably, said means are arranged to completely eliminate the effect on the slide of operating liquid retained in the channel.

With the present invention, at the same moment that operating liquid is discharged from the closing chamber through said valve, there is a reduction or elimination of the force which acts on the slide member in its closing direction by the operating liquid present in the channel. The opening movement of the slide member will thus be extremely rapid.

Additionally, when the valve which discharges operating liquid from the closing chamber is reclosed, operating liquid is already available in the channel for a rapid replacement of the operating liquid which has been discharged from the closing chamber. By giving the channel dimensions such that it can contain a relatively large amount of operating liquid, the limitation is avoided which is always present concerning rapid replacement, through the central parts of the rotor, of operating liquid which has been discharged from the closing chamber. In this way the fastest possible increase of the closing force acting on the slide member is achieved, and consequently also the fastest possible closing movement of the slide member.

Particularly advantageous is an embodiment of the invention in which said valve is a combination valve operable in a first position to maintain the closing chamber in communication with the channel and in a second position to close this communication but uncover an outlet from the closing chamber.

A combination valve of this kind preferably comprises an annular valve arranged within the closing chamber and sealingly abutting against a wall of the closing chamber facing axially toward the slide member, the annular valve being axially movable during operation of the rotor towards the slide member for uncovering an outlet slot for operating liquid extending around the axis of the rotor. In this way, a particularly rapid opening movement of the slide member is obtained.

Figure 2:
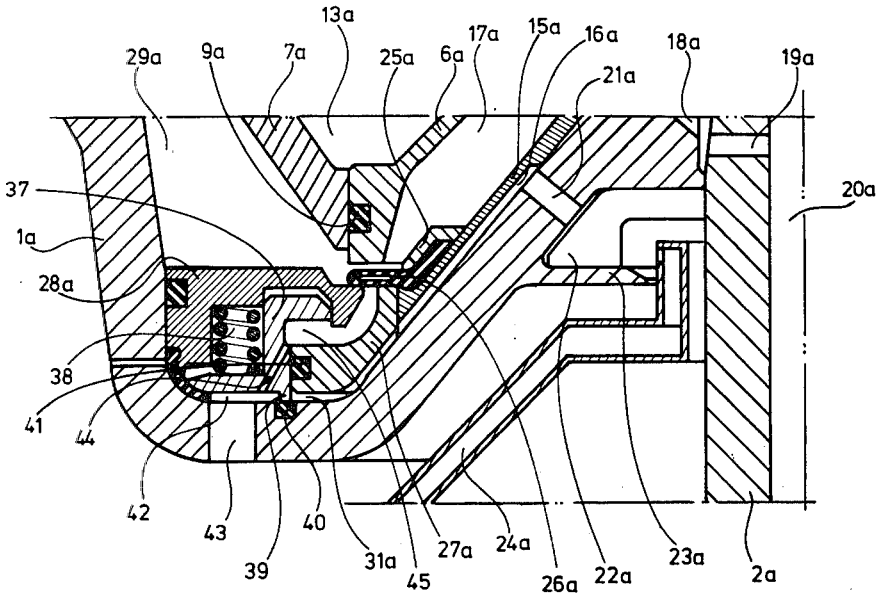

The present invention is described in more detail in the following, with reference to the accompanying drawings in which FIG. 1 is a vertical sectional view of one embodiment of the operating system according to the invention; and FIG. 2 is a similar view of a modification of the embodiment according to FIG. 1.

The centrifuge rotor as illustrated comprises a lower part 1 which is firmly connected with a drive shaft 2, and an upper rotor part 3. The rotor part 3 is fastened to the rotor part 1 by a number of bolts 4 distributed around the periphery of the rotor. The bolts 4 extend through sleeves 5 which serve as spacing members between the rotor parts 1 and 3. The sleeves 5 are situated in recesses in the rotor parts 1 and 3, which face each other, whereby the sleeves 5 are kept radially fixed. Between the sleeves 5 there are formed through-flow openings 50 between the interior and the outside of the rotor.

Within the chamber defined by the rotor parts 1 and 3 is a wall 6 which is immovable relative to the rotor parts, and a slide member 7 movable relative to all of the before-mentioned members. The slide member 7 seals by means of gaskets 8 and 9 against the rotor part 1 and the wall 6, respectively, and is arranged to be moved to and from engagement with the rotor part 3 immediately inside the sleeves 5. An annular gasket 10 seals between the slide member 7 and the rotor part 3.

On the wall 6 rests a distributor 11 which surrounds an inlet tube 12 for a mixture to be centrifuged. Between the rotor part 3, the slide member 7, and the distributor 11 is a separating chamber 13 of the rotor, which contains a set of conical separating plates or discs 14. At 14*a* there is shown an overflow outlet from the separating chamber 13.

Between the wall 6 and the rotor part 1 is a further wall 15 which forms with the rotor part 1 a channel 16. Between the walls 6 and 15 there is defined a chamber 17. Within the chamber 17 are a number of radial wings 51 connected to the wall 6 and serving to entrain liquid present in the chamber 17, corresponding wings 52 being present in the channel 16.

The chamber 17 has inlets 18 for so-called operating liquid and which communicate through a number of channels 19 with a central bore 20 in the drive shaft 2. Also, the channel 16 has inlets 21 for operating liquid and which start from a recess 22 formed by a projection 23 on the outside of the rotor part 1. Leading to the recess 22 is a stationary tube 24 for supply of operating liquid.

Between the wall 15 and a ring 25 there is clamped an annular flexible member 26. A radially outwardly directed flange or lip of this flexible member 26 is movable, by means of an axially movable secondary slide member 27, to and from sealing engagement with the radially outermost circumferential part of the wall 6.

In the space between the rotor part 1 and the slide 7 there is a radially inwardly directed flange 28 against which, at its radially innermost portion, said lip of the flexible member 26 may be caused to abut (as shown in FIG. 1). Between the slide member 7 and the flange 28 there is formed a chamber 29, and a further chamber 30 is formed between the flange 28 and the rotor part 1.

In the position of the slide member 27 shown in the drawing, communication is maintained between the chambers 17 and 29, whereas chamber 30 is kept separate from chambers 17 and 29. By upward movement of the slide member 27 towards the wall 6, the communication between chambers 17 and 29 may be closed and, instead, a communication opened between the chambers 29 and 30.

Like the walls 6 and 15, the slide member 27 is provided on its underneath side with radial wings 53 so that a chamber 31 is formed between the slide 27 and the rotor part 1. This chamber 31 communicates at its radially innermost part with the channel 16 and is confined at its radially outermost part by an annular member 32. A throttled channel 33 extends through the member 32 between the chambers 30 and 31; and through the rotor part 1 extends another, somewhat less narrow channel 34 from the chamber 31 to the outside of the rotor. If the channel 34 is placed at the radially outermost part of the chamber 31, the channel 33 is not required. Several radial wings are supported by flange 28 at its underside, one of these wings being shown at 35.

Leading outwardly from the chamber 30 is an overflow outlet in the form of a channel through a nozzle 36, which is adjustable to different radial positions.

In the operation of the illustrated rotor, the channels 20 and 19 keep the chambers 17 and 29 filled with operating liquid, so that the slide member 7 is forced upwardly to the position shown in FIG. 1, where it seals against the rotor part 3. In the channel 16 and in the chambers 30 and 31, the ambient pressure prevails (i.e., normally atmospheric pressure). Mixture to be centrifuged is supplied through the inlet tube 12 and enters the separating chamber 13 through the chamber between the distributor 11 and the wall 6, the latter chamber containing radial wings 54 for entraining the incoming mixture. Separated liquid leaves the separating chamber through the overflow outlet 14*a*.

When sludge separated in the separating chamber 13 is to be removed, operating liquid is supplied during a short period of time through tube 24 to the recess 2. This operating liquid flows outwardly through the channels 21 and 16 to the chamber 31, where it forces the secondary slide member 27 axially upwardly. The flexible member 26 thus closes the communication between chambers 29 and 30. This means that the main slide 7, after having been subjected to the pressure from a liquid column extending essentially to the rotation axis A of the centrifuge rotor, suddenly is subjected only to the pressure from the liquid column remaining radially outside the closed communication between the chambers 17 and 29. The slide 7 therefore moves rapidly downwards, operating liquid being caused to flow from the chamber 29 to the chamber 30. The peripheral openings 50 between the rotor parts 1 and 3 are thus uncovered, so that the separated sludge is thrown out of the separating chamber 13.

The liquid flowing out of the chamber 29 (displaced by the slide member 7) rapidly fills the chamber 30, whereby the secondary slide member 27 is caused to return to its lower position shown in the drawing. At this moment, the supply of operating liquid through the channels 21 and 16 has already been cut off, and the chamber 31 and the channel 16 are being emptied through the channel 34. It should be pointed out here that operating liquid is continually leaving the chamber 30 through the nozzle 36, but since the rate of supply of operating liquid from the chamber 29 is substantially larger than the rate of discharge through the nozzle 36, the chamber 30 will be rapidly filled. When chamber 30 is filled, the liquid pressure therein will be determined by the position of the liquid level within the separating chamber 13 because through the slide member 7, which has not descended to its lowermost position, the liquid column in separating chamber 13 influences the liquid pressure in the chambers 29 and 30. The upwardly directed pressure on the secondary slide member 27 from operating liquid remaining in the chamber 31 and the channel 16 is thus overcome by the pressure in the chamber 30 when the latter is filled.

When the secondary slide member 27 is pressed back to its position shown in FIG. 1, in which the communication between the chambers 29 and 30 is closed, the operating liquid discharged from the chamber 29 is replaced by new operating liquid from chamber 17. The main slide member 7 will therefore return rapidly to its position shown in the drawing, wherein the peripheral outlets of the separating chamber 13 are closed.

The chamber 17 has a relatively large volume and therefore contains a substantial amount of operating liquid. This means that the pressure from the liquid column in chamber 17 is changed only to a minor extent, or not at all, by the fact that some of the operating liquid flows to the chamber 29 to replace operating liquid discharged therefrom. When the secondary slide member 27 moves downwards, the main slide member 7 consequently will only momentarily remain in its position wherein the peripheral outlets of the separating chamber 13 are maximally open, as it will immediately be subjected to a pressure acting to close said peripheral outlets, which pressure is determined by the liquid column in the chamber 17. The slide member 7 will thus return very rapidly to its closing position shown in the drawing.

The point of time for the return of slide member 7 towards the position shown in FIG. 1, from the time of opening of the communication between the chambers 29 and 30, is determined almost entirely by the amount of operating liquid which can leave the chamber 29 before the chamber 30 is filled. This amount of operating liquid may be governed by radial adjustment of the nozzle 36, so that the surface of the operating liquid remaining in chamber 30 is maintained at a desired level. By radially outward displacement of the nozzle 36, the normally unfilled part of the chamber 30 may thus be increased, thereby increasing the period of time during which the peripheral outlets of the separating chamber 13 are kept open.

If it is found necessary, a very narrow axial bore (not shown) may extend through the flange 28 so that operating liquid is constantly supplied to the chamber 30, thus assuring that the liquid level therein is maintained at the radially inner channel opening of the nozzle 36. Such a bore should not let in more liquid to the chamber 13 than can leave through the nozzle 36.

In FIG. 2, details which have their counterparts in FIG. 1 have been given the same reference numerals with the addition of a letter a.

In the embodiment of FIG. 2, there is inserted between the flange **28*a* and the lowermost portion of the rotor part 1*a* an axially movable ring 37. By means of a number of coil springs 38, the ring 37 is pressed downwardly so that a downwardly directed projection 39 of the ring 37 is caused to seal against a gasket 40. Between the ring 37 and the secondary slide member 27*a* there is arranged a further gasket 41, whereby the chamber 31*a* may be kept closed at its radially outermost part. At the abutment of the projection 39 against the gasket 40 there is formed between the ring 37 and the rotor part 1 a chamber 42 with an outlet 43. Through the ring 37, a throttled channel 44 extends from the chamber 42 to a chamber 45 which is defined by the secondary slide member 27*a*, the ring 37, the flange 28*a*, and the flexible member 26*a***.

In a starting position, the chambers **17*a* and 29*a* are filled with operating liquid, whereas the spaces 16*a*, 31*a*, 42 and 45 are empty and are subjected to the ambient pressure (atmospheric). When the peripheral outlets of the separating chamber 13*a* are to be opened, operating liquid is supplied for a short period of time through the tube 24*a* to the channel 16*a* and the chamber 31*a*. The secondary slide member 27*a* is thus pressed upwards and actuates the member 26*a* to open the communication between chambers 29*a* and 45 while closing the communication between the chambers 17*a* and 29*a***.

During downward movement of the main slide member **7*a*, liquid then flows from the chamber 29*a* to the chamber 45, which is rapidly filled. When chamber 45 is filled with liquid, and the liquid pressure becomes dependent upon the liquid column in the separating chamber 13*a* (see previous description in connection with FIG. 1), the secondary valve 27*a* is pressed downwardly toward its position shown in FIG. 2. At the same time, the ring 37 is pressed upwardly and thereby opens the chamber 31*a* to the outlet 43. Operating liquid remaining in the chamber 31*a* and the channel 16*a* will thus be rapidly drained off, whereby the upwardly directed liquid pressure against secondary valve 27*a*** is eliminated.

Of course, the strength of the coil springs 38 may be made such that the ring 37 is displaced upward before the chamber 45 is filled with liquid. Further, the size of the chamber 45 may be selected so that the secondary slide member **27*a* is caused to return to its position shown in the drawing at a predetermined point of time after the communication between chambers 29*a* and 45** has been opened.

I claim:

1. A centrifugal separator comprising a rotor mounted for rotation about an axis and forming a separating chamber having a central inlet for a liquid mixture of at least two components, said chamber also having a central outlet for a lighter separated component and peripheral outlets distributed around the rotor's periphery for a heavier separated component, an annular slide movable axially in the rotor during rotation thereof for opening and closing said peripheral outlets, the slide forming with the rotor a closing chamber communicating with a channel extending radially inward from the closing chamber, means for charging said channel to fill the channel and closing chamber with operating liquid actuating the slide hydraulically to a position for closing said peripheral outlets, a valve in the rotor for discharging operating liquid from the closing chamber, whereby the slide is pressed to a position for opening said peripheral outlets, and valve means operable for closing the connection between said channel and the closing chamber for retaining operating liquid in said channel and thereby maintaining the operating liquid pressure therein substantially unchanged, said valve means also being operable to eliminate the hydraulic pressure on the slide caused by operating liquid thus retained in the channel.

2. The separator of claim 1, in which said valve means has a first position for keeping the closing chamber in communication with said channel, and a second position for closing the communication of the closing chamber with said channel while uncovering an outlet from the closing chamber.

3. The separator of claim 1, in which the rotor has an additional chamber located radially inside the closing chamber and constituting part of said channel, said additional chamber containing a buffer amount of operating liquid.

4. The separator of claim 1, in which the buffer liquid chamber has walls which are immovable relative to each other.

5. The separator of claim 1, in which said valve means includes an annular valve disposed within the closing chamber and sealingly abutting against a wall of the closing chamber, said wall facing axially toward said slide, the valve being axially movable toward the slide for uncovering an outlet slot for operating liquid, said slot extending all around the rotor axis.

6. The separator of claim 5, in which said annular valve is movable toward the slide to also close the connection between the radially inner part of the closing chamber and said channel.

7. The separator of claim 1, in which the closing chamber has an outlet for operating liquid at substantially the same radius as said connection between the closing chamber and said channel.

8. The separator of claim 7, in which said outlet is the only outlet from the closing chamber.

9. The separator of claim 7, comprising also a set of conical separating discs in the separating chamber, said radius being substantially the radius of the radially outer edges of the separating discs.

10. The separator of claim 1, in which part of said valve means is exposed in a chamber arranged to receive operating liquid discharged from the closing chamber, said valve means being operable in response to filling of said chamber with operating liquid to reopen the connection between the closing chamber and said channel.

11. The separator of claim 1, in which said valve means is operable to close the connection between the closing chamber and said channel by being subjected to pressure from liquid introduced in a separate chamber, the separator comprising also a secondary valve having a part exposed in a secondary chamber for receiving operating liquid discharged from the closing chamber, said secondary valve being operable in response to at least partial filling of the secondary chamber to uncover an outlet from said separate chamber.

* * * * *